United States Patent [19]

Hilfiker

[11] 4,260,296

[45] Apr. 7, 1981

[54] ADJUSTABLE CAP FOR RETAINING WALLS

[75] Inventor: William K. Hilfiker, Eureka, Calif.

[73] Assignee: The Reinforced Earth Company, Washington, D.C.

[21] Appl. No.: 46,866

[22] Filed: Jun. 8, 1979

[51] Int. Cl.[3] ..... E02D 29/02

[52] U.S. Cl. ..... 405/284; 52/300; 404/7; 405/287

[58] Field of Search ..... 405/15, 262, 272, 273, 405/284, 285, 286, 287; 52/102, 244, 293, 300; 404/6, 7, 8

[56] References Cited

U.S. PATENT DOCUMENTS

| | | | |
|---|---|---|---|
| 1,004,145 | 9/1911 | Campfield | 52/300 |
| 2,035,050 | 3/1936 | Clare | 405/273 |
| 2,165,500 | 7/1939 | Muirhead | 52/300 X |
| 2,815,656 | 12/1957 | Klein et al. | 52/300 X |
| 3,546,720 | 12/1970 | Hoch et al. | 52/300 X |
| 4,051,570 | 10/1977 | Hilfiker | 405/273 X |
| 4,068,482 | 1/1978 | Hilfiker | 405/272 |

FOREIGN PATENT DOCUMENTS

| | | | |
|---|---|---|---|
| 202626 | 10/1908 | Fed. Rep. of Germany | 405/284 |
| 242367 | 1/1912 | Fed. Rep. of Germany | 405/284 |

*Primary Examiner*—David H. Corbin

*Attorney, Agent, or Firm*—Naylor, Neal & Uilkema

[57] ABSTRACT

An elongate concrete element is adjustably secured to the top of a retaining wall to provide a cap which may be adjusted for elevation and inclination relative to the wall. The element is provided with a skirt which extends over the side of the wall to span the space between the element and the wall. The element provides a forming surface against which a cementitious material, such as a concrete roadway, may be poured. The forming surface and skirt prevent the cementitious material from passing through or over the wall. The element also provides a screeding edge for the cementitious material.

9 Claims, 4 Drawing Figures

ADJUSTABLE CAP FOR RETAINING WALLS

BACKGROUND OF THE INVENTION

The present invention relates to retaining walls for earthen formations and, more particularly, is directed to a cap for such a wall to provide for selective adjustment of the elevation and inclination of the upper edge of the wall and a forming surface against which a cementitious material may be formed to one side of the wall.

My prior U.S. Pat. Nos. 4,051,570; 4,068,482; and prior U.S. Application Ser. No. 966,119, filed Dec. 4, 1978, disclose retaining walls of the type with which the present invention is concerned. U.S. Pat. No. 4,051,570 is particularly significant in that it discloses a bridge abutment wherein precast stretchers are topped with cap elements and a cementitious roadway is poured between the cap elements. The cap elements in this patent, however, are secured directly against the stretchers therebeneath and no provision is made for selectively adjusting the elevational inclinaton of the cap elements relative to the stretchers.

Another patent showing retention walls of the type with which precast cap elements have been used in U.S. Pat. No. 3,686,873 to Vidal. The cap elements used with walls of the type disclosed in this patent have provided forming surfaces against which cementitious material may be poured and have also been provided with skirt elements to span any space between the elements and the top of the retaining wall. Such cap elements rest in place and are anchored by extensions fixed to the elements and embedded into the cementitious material cast thereagainst.

SUMMARY OF THE INVENTION

The cap elements of the present invention are for use in combination with a preformed retaining wall for an earthen formation. The elements are elongated and extend lengthwise over the wall and adjustable support means are interposed between the wall and elements to support the elements on the wall and provide for the selective adjustment of the elevation and inclination of the elements relative to the wall. Skirt members depend downwardly from at least one side of the cap elements for extension over the side of the retaining wall, irrespective of the elevational or inclinational adjustment of the cap elements relative to the wall.

A principal object of the invention is to provide a cap element for a retention wall wherein the elevation of the element relative to the wall may be selectively varied.

Another and related object of the invention is to provide such a cap element wherein the inclination of the cap element relative to the wall may be selectively varied.

Still another object of the invention is to provide such a cap element which is securely anchored in place and may serve as a forming surface against which cementitious material may be poured.

A further objection of the invention is to provide such a cap element wherein a surface on the element may serve as a screed guide for cementitious material poured against the element.

The foregoing and other objects will become more apparent when viewed in light of the accompanying drawings and the following detailed description.

DESCRIPTION OF THE PREFERRED EMBODIMENT

Figure 1:
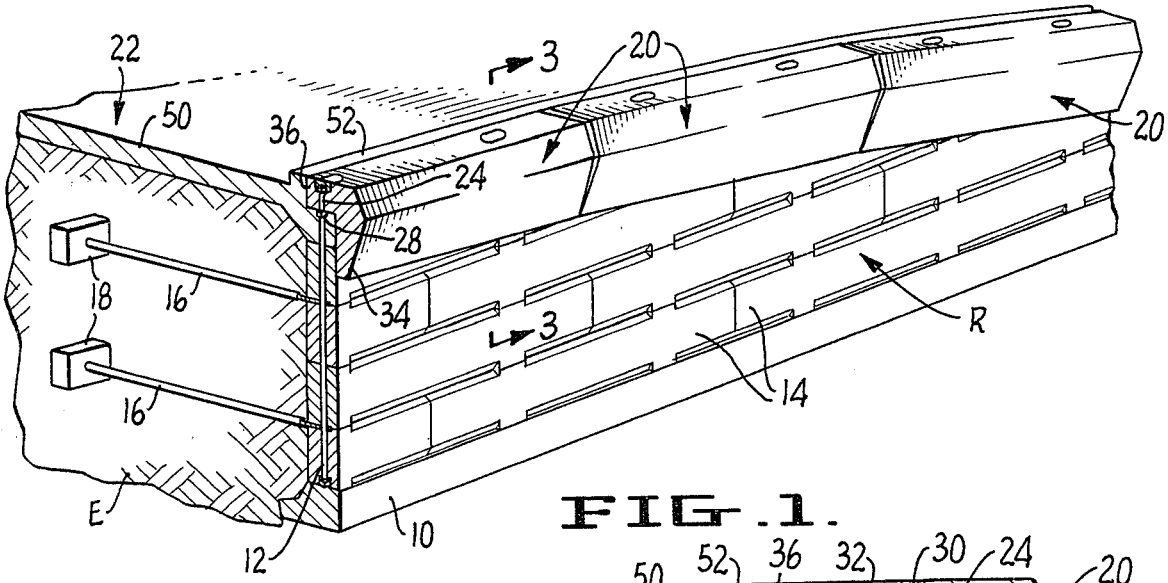
FIG. 1 is a perspective view, partially in section, illustrating an earthen formation held in place by a retention wall provided with a cap construction according to the present invention.

Referring now to FIG. 1, the earthen formation is designated therein by the letter "E" and is shown as being held in place by a retaining wall "R". The retaining wall is the same general type shown in my U.S. Pat. No. 4,068,482 and comprises: a foundation 10; tie rods 12 extending upwardly from the foundation; a plurality of rows of stretchers 14 supported on the foundation in stacked relationship to one another with the tie rods 12 extending through passages therein; dead men anchor rods 16 having plates 17 secured to the distal ends thereof (see FIG. 3) in encircling relationship to the tie rods 12; dead man anchors 18 secured to the inner ends of the rods 16 and embedded in the earthen formation "E"; cap elements 20 supported on the tie rods 12 above the uppermost layer of stretchers 14; and, a concrete roadway 22 cast in place on the earthen formation "E" against one side of the cap elements 20. The foundation 10 is generally cast in place in situ. The stretchers 14 are preformd and assembled into place on the foundation, with the deadman anchors and anchor rods therefor, together with the back-fill, progressively placed as the retaining wall is erected. As shown, the uppermost layer of stretchers is stepped to provide a wall which decreases the height from one end of the wall to the other.

The upper ends of the tie rods 12 include threaded extensions 24 which extend through slotted passages 26 therefor in the cap elements 20. Adjustment nuts 28 are threadably received on the extensions 24 for engagement with the upper side of the elements 20. The nuts 30 are received in sockets 32 formed therefor in the cap elements. After the cap elements are fully assembled into place and adjusted with the nuts 28 and 30 engaged with either side of the elements, the sockets 32 are grouted over, as can be seen from FIGS. 3 and 4.

Figure 2:
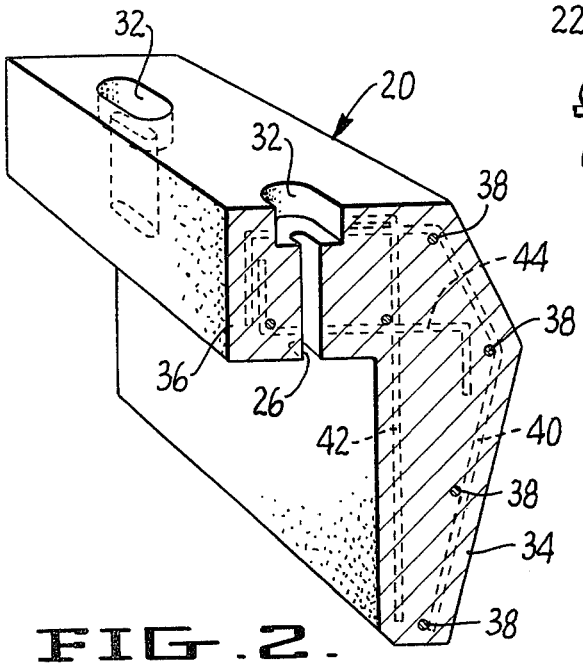
FIG. 2 is a cross-sectional elevational view, in perspective, illustrating a cap element constructed according to the present invention.
Figure 3:
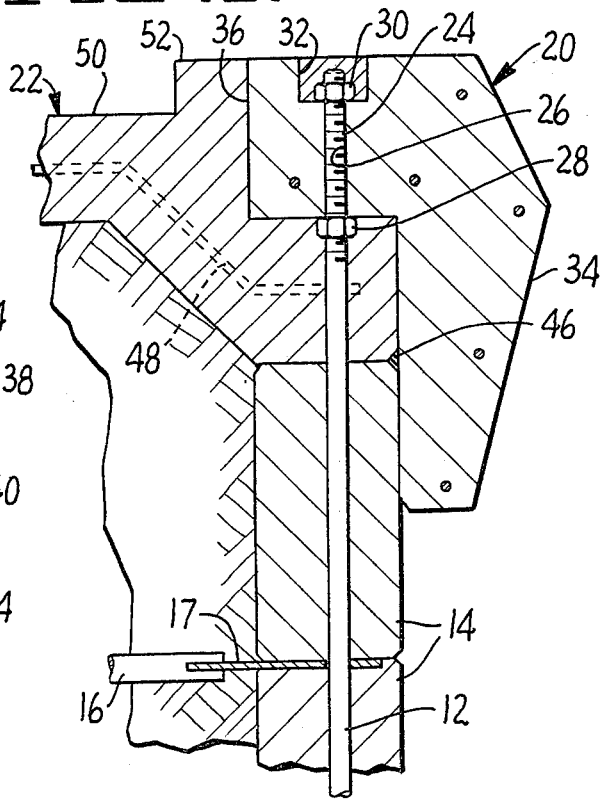
FIG. 3 is a cross-sectional elevational view, taken on the plane designated by line 3—3 of FIG. 1.

As viewed in cross-section, as can be seen from FIGS. 1, 2 and 3, the cap elements 20 are of a generally inverted I-shaped configuration. The downwardly extending leg of the L, designated 34, provides a skirt which extends over the outside of the row of stretchers 14 immediately below the cap, even though said row may be stepped or inclined. The laterally extending section of the L, designated 36, provides the section of the cap member through which the passages 26 extend. The passages 26 are elongated in the direction of the elongate dimension of the cap elements so that the elements may be inclined relative to the tie rods 12 (see FIG. 4).

The cap elements 20 are precast at a factory and delivered to the situs of the wall in the preformed condition. Each element is fabricated of concrete and has reinforcing elements 38 extending longitudinally therethrough and reinforcing elements 40, 42 and 44, extending laterally therethrough (see FIG. 2). In a typical embodiment, the cap element measures 12 feet 6 inches long, two feet nine inches high, 6 inches across the lower extremity of the skirt 34, 18 inches across the top of the lateral section 36, and 9 inches across the depth of the section 36.

Figure 4:
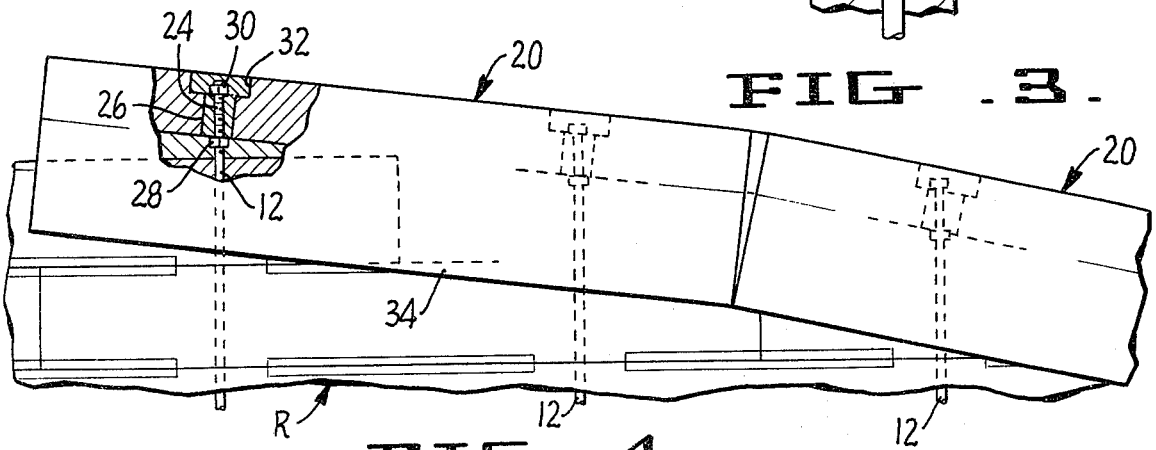
FIG. 4 is an elevational view, with parts thereof broken away and shown in section, illustrating a retaining wall provided with a cap constructed according to the present invention.

In application, after the retaining wall was erected with the extensions 24 extending upwardly from the uppermost row of stretchers, the nuts 28 are adjusted to the desired position for supporting the cap elements. Where the wall is sloped from one end to another, this adjustment would be such as to incline the cap elements relative to the stretchers of the wall, as seen in FIG. 4. After the nuts 28 are adjusted to the desired positions, the cap elements are lowered into place over the extensions 24 and any final adjustments of the nuts 28 are made. Thereafter, the securing nuts 30 are threaded on to the extensions 24 and tightened into engagement with the lower surfaces of the sockets 32. Next, sealing mastic 46 is applied along the line between the outer upper edge of the uppermost row of stretchers and the inside surface of the cap elements (see FIG. 3). At or about this same time, a sealing cement or mastic may be applied to any space between the adjacent ends of the cap elements. It should be appreciated that the application of the mastic 46 and any cement or mastic between the adjacent ends of the cap elements takes place prior to the formation of the roadway 22.

After the cap elements are secured in place and sealed, the cementitious material for the roadway 22 is poured into place and against the inner side of the cap elements. If desired reinforcing steel, such as the reinforcing element 48 depicted in FIG. 3, may be placed in the road bed prior to pouring of the cementitious material. In the embodiment illustrated, the material is concrete and formed so that the main surface of the roadway, designated 50, is beneath the upper level of the cap elements and a curb section 52 is formed to either side of the main surface of the roadway to a level coplanar with the upper level of the cap element. In this case, the surface provided by the top of the cap element may be used as a screed guide.

CONCLUSION

From the foregoing description, it is believed apparent that the present invention enables the attainment of the objects initially set forth herein. In particular, the invention provides an adjustable cap element for a retaining wall, which elements is adjustable to accommodate an inclined and/or stepped retaining wall. The cap element serves not only to finish the wall, but to provide a forming surface against which the adjacent cementitious structure, such as a roadway, may be poured. It should be understood, however, that the invention is not intended to be limited to the specifics of the illustrated and described embodiment, but rather is defined by the accompanying claims.

What is claimed is:

1. In combination with a retaining wall comprised of precast concrete stretchers assembled into stacked superimposed relationship, the improvement comprising: screw threaded rods secured to and extendng upwardly from the uppermost stretchers of the wall; adjusting nuts threadably received on said rods for select threadable movement thereon up and down relative to said stretchers; performed elongated cap elements extending lengthwise over said uppermost stretchers; said elements having openings therein for receipt of said rods; support surface means on said elements engageable with said adjusting nuts to support said cap elements on said nuts in spaced relationship to said uppermost stretchers for select elevational adjustment relative thereto; and skirts formed on the cap elements for extension over the outside surfaces of the stretchers disposed beneath said cap elements, said skirts being of a depth sufficient to cover the space between the cap elements and the uppermost stretchers, irrespective of elevational adjustment of said cap elements relative to said stretchers, whereby said skirts may function as a form surface to capture cementitious material poured between the cap elements and the uppermost stretchers.

2. In a combination according to claim 1, the improvement further comprising: securing nuts threadably received on said rods above said cap elements; and securing surface means engageable with said nuts to secure the cap elements in adjusted condition relative to adjustment nuts.

3. In a combination according to claim 1, the improvement wherein the openings in the cap elements are of a cross-sectional area greater than that of the rods received therein whereby the openings can accommodate elevational adjustment of the cap elements to adjust the inclination of the cap elements relative to said uppermost stretchers.

4. In a combination according to claim 1, the improvement further comprising surfaces on the cap elements to provide a form against which in situ formed cementitious material may be poured, said surfaces together with said skirts functioning to confine such cementitious material against passage through or over the retaining wall.

5. In a combination according to claim 4, the improvement further comprising screed sections formed on said cap elements to provide a screed guide for cementitious material poured against the cap elements.

6. In a combination with a preformed retaining wall for an earthen formation, the improvement comprising: elongated cap elements extendng lengthwise over the top of said wall; adjustable support means interposed between said wall and elements to support the elements on the wall in spaced relationship to the top of the wall and provide for the selective adjustment of the elevation and inclination of the elements relative to the wall; and skirt members depending downwardly from at least one side of said cap elements for extension over the side of the retaining wall, said skirt members being of a depth sufficient to cover the space between the cap elements and the top of the wall irrespective of the elevational or inclinational adjustment of the cap elements relative to the wall, whereby said skirt members may function as a form surface to capture cementitious material poured between the cap elements and the top of the wall.

7. In a combination according to claim 6, the improvement further comprising securing means to secure the cap elements in adjusted condition relative to the support means and against separation from the wall.

8. In a combination according to claim 2, the improvement further comprising surfaces on the cap elements to provide a form against which cementitious material may be poured, said surfaces together with said skirt members functioning to confine such cementitious material against passage through or over the retaining wall.

9. In a combination according to claim 8, the improvement further comprising screed sections formed on said cap elements to provide a screed guide for cementitious material poured against the cap elements.

* * * * *